US005960477A

United States Patent [19]

Dixon

[11] Patent Number: 5,960,477

[45] Date of Patent: Oct. 5, 1999

[54] HAT WITH FOLDED RIM AND VISOR

[76] Inventor: Amber Dixon, P.O. Box 402768, Hesteria, Calif. 92345

[21] Appl. No.: 09/010,843

[22] Filed: Jan. 22, 1998

Related U.S. Application Data

[60] Provisional application No. 60/036,374, Jan. 22, 1997.

[51] Int. Cl.[6] ..... A42B 1/06

[52] U.S. Cl. ..... 2/195.1; 2/172; 2/195.7

[58] Field of Search ..... 2/172, 195.1, 195.7, 2/195.8, 10, 181, 181.2, 181.4

[56] References Cited

U.S. PATENT DOCUMENTS

| | | | |
|---|---|---|---|
| 80,352 | 7/1868 | Imbach et al. . | |
| 442,921 | 12/1890 | Stohr . | |
| 1,175,167 | 3/1916 | Moscherrosch | 2/195.1 |
| 1,538,847 | 5/1925 | Wheeler | 2/195.7 |
| 2,143,265 | 1/1939 | Goldstein | 2/172 |
| 2,149,655 | 3/1939 | Yamaguchi . | |
| 2,158,861 | 5/1939 | Meyer . | |
| 2,417,986 | 3/1947 | Marder . | |
| 2,420,569 | 5/1947 | Sewell . | |
| 2,651,044 | 9/1953 | Stankiewicz et al. . | |
| 4,601,070 | 7/1986 | Sargentini . | |
| 5,471,684 | 12/1995 | Casale . | |
| 5,481,759 | 1/1996 | Rinaldi . | |

FOREIGN PATENT DOCUMENTS

| | | |
|---|---|---|
| 621305 | 5/1927 | France . |

*Primary Examiner*—Diana L. Oleksa
*Attorney, Agent, or Firm*—Greenberg & Lieberman, P.C.

[57] ABSTRACT

A multi functional hat consisting of a visor or brim attached to a hemispherically-shaped snow hat body which fits closely to a wearer's head. The hat's body is formed with several basic stitches. A flap is disposed at the point where the visor or trim attaches to the hat's body. An upper fold emanates from the lower periphery of the hat's body, and the fold can be partially lowered to provide added protection and warmth.

10 Claims, 2 Drawing Sheets

HAT WITH FOLDED RIM AND VISOR

Priority is claimed to Provisional Application No. 60/036,374, filed Jan. 22, 1997, by Amber Dixon, entitled Multifunctional Hat.

FIELD OF THE INVENTION

The present invention relates generally to caps and hats utilized to keep a person's head warm, and more specifically, to a multifunctional hat having a primarily flexible body with an attached brim or visor serving to protect the person's face from falling and blowing precipitation, as well as sunlight and wind. The multi functional hat is compact, easily adaptable to a variety of head sizes, and represents a blend between protection and functionality.

BACKGROUND OF THE INVENTION

Caps and hats vary greatly in terms of design and functionality. While baseball hats are very trendy in contemporary times, they fail to provide the warmth necessary for extreme drops in temperature. A typical baseball cap is constructed of a webbed plastic mesh. Such a hat prevents sun from obstructing the wearer's view, but the hat does little in the way of maintaining body heat. In fact, baseball hats are generally worn as ornamental pieces outside the realm of sporting events. Although some baseball hats are constructed of heavy cotton and other materials, the basic skeleton of a baseball hat forces the hat to sit atop the wearer's head, not on and around the wearer's head.

Snow hats, on the other hand, are traditionally constructed primarily of wool and acrylic. They are designed to keep the wearer's head warm. In this regard, a typical snow hat exhibits uniform construction and has little structural integrity when removed from the wearer's head. Snow hats are not intended to be rigged and present obstructions to the sun, wind, and rain; but rather, snow hats are designed to be close fitting and insulating with respect to the wearer's head, maintaining anterior temperature as moisture and heat are conserved.

The prior art is replete with various types of hats, none of which approach the design and functionality of the present invention.

U.S. Pat. No. 80,352, issued to Ibach and Weidenman on Jul. 28, 1868, illustrates a method of attaching a paper visor to a paper cap wherein a visor and a loop of material is fitted to the bottom rim of a skullcap. When the cap becomes dirty, the visor can be attached to another cap, whereas in the present invention, the visor must firmly remain in combination with a head covering to remain fully effective. Moreover, unlike the present invention, Ibach and Weidenman's device does not flexibly surround the user's head to promote heat retention. U.S. Pat. No. 442,921, issued to Stohr on Dec. 16, 1890, shows a knitted cap with a visor in which a hat with depending ear flap and ties is combined with a visor. Stohr, unlike the present invention, does not provide any means of capturing moisture from the brow or forehead of the user during athletic activity. Furthermore, Stohr's invention, unlike the present invention, employs incisions in the cap to attach the visor.

U.S. Pat. No. 2,149,655, issued to Yamaguchi on Aug. 3, 1938, illustrates a head covering made entirely of crocheting yarn. The device discloses a means for reinforcing a crocheted visor to a crocheted hat. Unlike the present invention, Yamaguchi's device is concerned with forming a bead at the junction of the crown and the visor to add stability to stiching.

U.S. Pat. No. 2,158,861, issued to Meyer on Sep. 2, 1937, shows a visor for collapsible caps which is capable of assuming a flat position when a collapsible cap is in a folded, flat position. Unlike the present invention, Meyer's device is not capable of providing a visor in combination with a knit type hat.

U.S. Pat. No. 2,417,986, issued to Marder et al. on Mar. 25, 1947, is directed to a cap and visor with draw strings extending to the nape of the user's neck. Unlike the present invention, Marder's invention has multiple lines of stitching and is secured behind the user's head.

U.S. Pat. No. 2,420,569, issued to Sewell on May 13, 1947, shows a baseball cap. Unlike the present invention, Sewell's device has a visor which is attached to the crown of the cap.

U.S. Pat. No. 2,651,044, issued to Stankiewicz et al. on Sep. 8, 1953, depicts a scarf hat having interfitting concentric outer and inner head band members for receiving between them an edge of a scarf. Unlike the present invention, the visor is attached by fitting between the outer and inner head band members.

U.S. Pat. No. 4,601,070, issued to Sargentini on Jul. 22, 1986, shows a novelty ski hat. Unlike the present invention, there is no visor attached to the hat.

U.S. Pat. No. 5,471,684, issued to Casale on Dec. 5, 1995, shows a sports cap with a sliding brim. Unlike the present invention, the brim is detachably secured to the bottom edge of the cap. Furthermore, unlike the present invention, the majority of the cap can be detached from the bottom edge of the cap.

U.S. Pat. No. 5,481,759, issued to Rinaldi on Jan. 9, 1996, illustrates an expandable baseball hat and cover. Unlike the present invention, Rinaldi's device employs tabs engaged to gather flexible material for a snug fit. The present invention, by nature of its design, fits snugly to the user's head without employing a complicated tab system.

French Publication No. 621,305, invented by Menant and published on May 9, 1927, shows a woven cap. Unlike the present invention, Menant's device employs multiple stiches about the middle periphery of the cap. Further, Menant's device is not designed, by virtue of its shape and inability to snugly fit the user's head, for athletic use.

Accordingly, the need arises for a multi functional hat with a brim or visor, which is a blends the functionality of both the typical snow hat and the typical baseball cap. The multi functional hat must be rigid so as to protect the wearer's face from the outdoor elements. Moreover, the multi functional hat should be capable of maintaining the warmth of the wearer's head despite baseball cap type adaptations. The multi functional hat should be of a design that does not compromise the advantages of existing snow hats, while at the same time, exploiting the current weaknesses of headgear design.

SUMMARY OF THE INVENTION

By the present invention, a multi functional hat for protection from falling and blowing precipitation, as well as the sun and wind, is disclosed. The multi functional hat maintains direct contact with the wearer's head, and can be shaped to snuggly fit around the anterior head region. Furthermore, the multi functional hat has adaptations which extend to cover the sides of the posterior portion of the wearer's head, including the ear region. The wearer's face is protected by a brim or visor which extends outward from the front of the present invention.

Accordingly, one of the objects of the present invention is to provide a multi functional hat for prevention of injuries associated with poor visibility caused by blowing snow, bright sunlight, heavy sleet, and other natural phenomena which interfere with a person's eye sight.

Another of the objects of the present invention is to provide a multi functional hat which is capable of conveying messages and displaying emblems.

Yet another of the objects of the present invention is to provide a multi functional hat which is capable of maintaining a tight fit with the wearer's head to ensure warmth, while at the same time, providing the resiliency necessary to promote frontal support for a brim or visor.

Still another of the objects of the present invention is to provide a multi functional hat which includes an adaptation for covering of the wearer's ears.

A further object of the present invention is to provide a multi functional hat which is easily manufactured from readily available materials, such that the assembly cost associated with the present invention is held to a minimum.

Another object of the present invention is to provide a snow hat for the purposes described which is inexpensive, dependable and fully effective in accomplishing its intended purpose.

In view of the above-mentioned and other objects, all of which will become more readily understood as the nature of the present invention is better understood, the invention comprises in the novel combination and arrangement of parts hereinafter more fully described, illustrated, and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
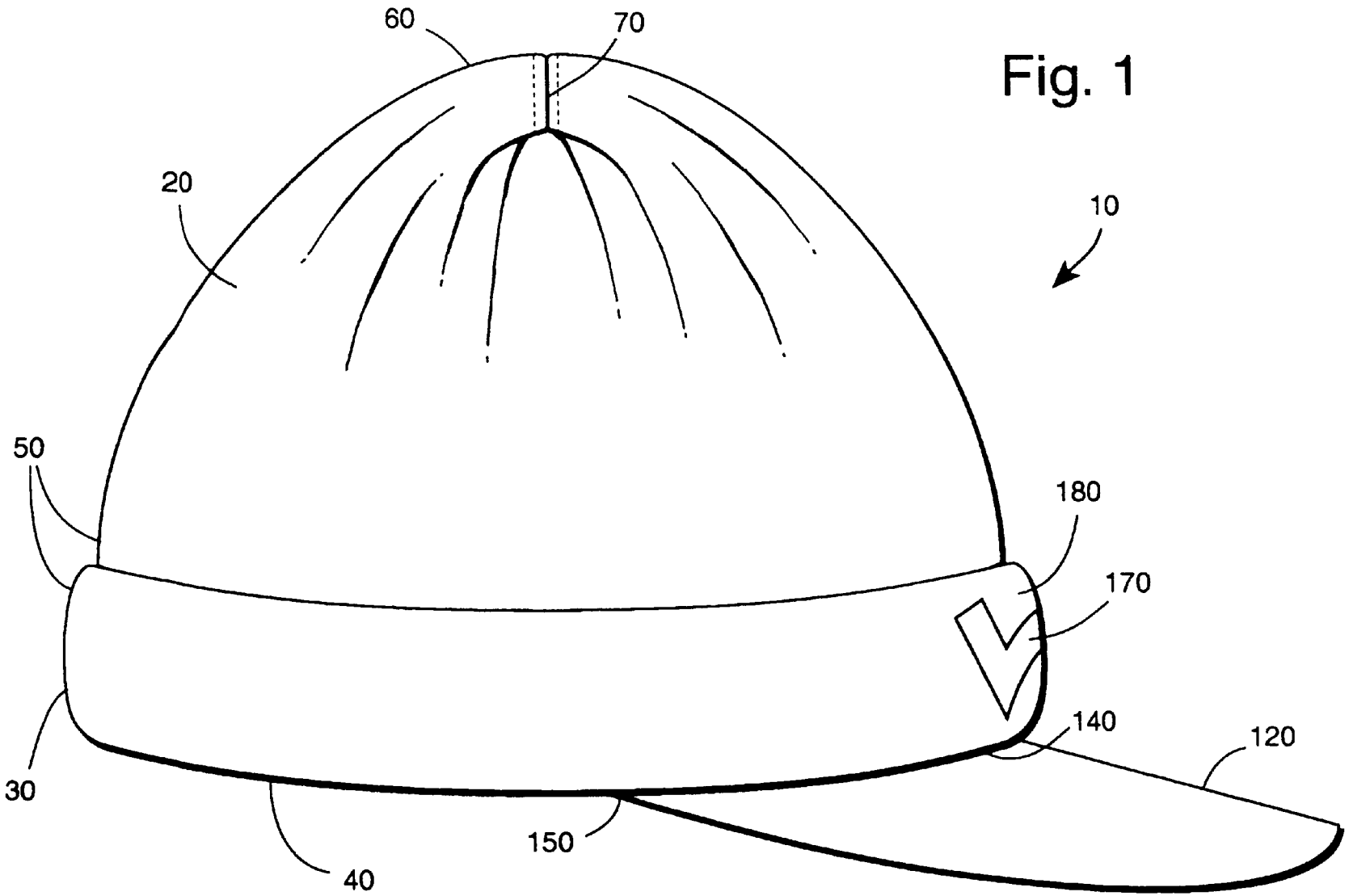
FIG. 1 is a left side perspective view of the present invention.

The present invention will be seen to relate to a multi functional hat 10 of unique design. The present invention is comprised primarily of a soft material body 20, preferably acrylic, wool, or cotton. The hat 10 has a primary purpose of sustaining the temperature of a wearer's head in cold weather. Thus, the body 20 of the hat 10 is soft and "form fitting" to the wearer's head (not shown) in order to effectively insulate against cold temperatures. In the preferred embodiment of the present invention, as shown in FIG. 1, an upper fold 30 emanates along the lower periphery 40 of the hat 10. The fold 30 increases the pressure of the lower periphery 40 of the hat 10 on the wearer's head (not shown), further increasing the heat sustaining capabilities of the hat 10.

Figure 2:
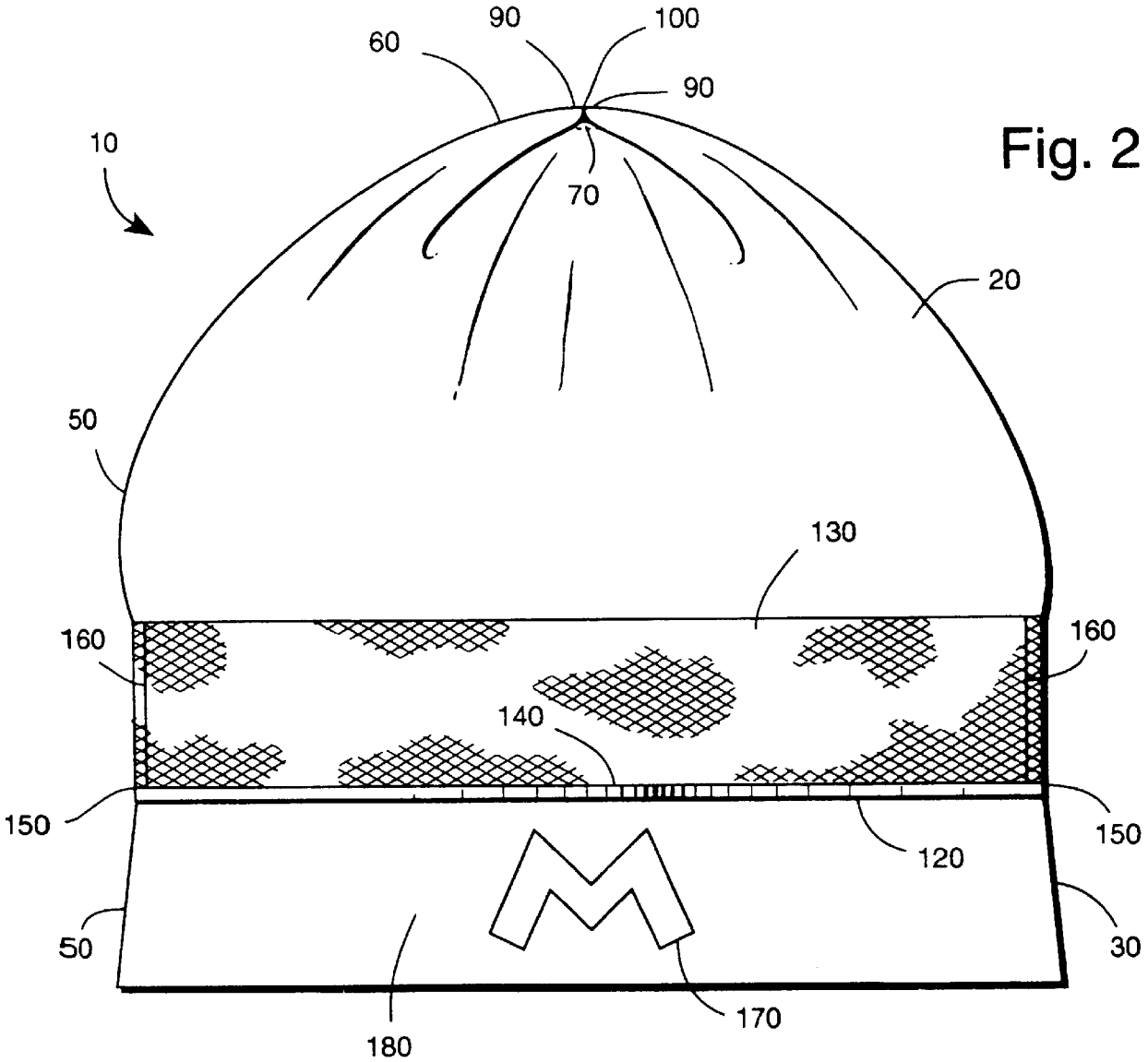
FIG. 2 is a front side perspective view of the present invention turned "inside out."

To further secure the hat 10 on the wearer's head (not shown), various conventional constructions may be employed. In the preferred embodiment, as shown in FIG. 2, the hat 10 is shown turned "inside out." The body 20 of the hat 10 is formed of a single piece of tubular material 50. The top 60 of the tubular material 50 is sewn shut with a reinforced seam 70 which appears as a thick knubbed edge. The reinforced seam 70, while not uncomfortable to the wearer (not shown), serves to provide stability and rigidity to the body 20 of the hat 10. The two corners 90 of the reinforced seam 70 are fastened together with a heavy duty stitch 100. The body 20 of the hat 10 forms a hemispherical shape (as shown in FIG. 1) due to the joint of two corners 90 of the reinforced seam 70.

A visor or brim 120 is frontally mounted on the present invention along the lower periphery 40 of the hat 10. The visor or brim 120 serves to maintain the structural integrity of the upper fold 30, while at the same time, allowing the upper fold 30 to be unrolled in a downward direction so as to cover the wearer's ears (not shown) and neck (not shown). The visor or brim 120 is ideally suited to protect the wearer's face (not shown) against the ravages of sun, wind, rain, snow, ice, and other atmospheric conditions.

To further insulate the wearer's head (not shown) against the elements, the present invention is provided with a flap 130 disposed toward the back 140 of the visor or brim 120. The flap 130 is formed of a strong and/or absorbent material which aids in preventing perspiration (not shown) from dripping into the user's eyes (not shown) and down the user's face (now shown). The flap 130 also provides increased insulation against head winds and blowing precipitation. The flap 130 is horizontally joined to the body 20 of the hat 10 along the back 140 of the visor or brim 120, as well as joined behind the upper fold 30 at the rear edges 150 of the visor or brim 120. The flap's joint 160 at the rear edges 150 of the visor or brim 120 attaches to the body 20 of the hat 10 such that the flap 130 is angled in the plane of the brim or visor 120.

For purposes of advertising and identification, a marking 170 may be exhibited on the front face 180 of the upper fold 30. Any conventional means is utilized to sew and/or adhesively attach the marking 170. The marking 170 is most often a word, slogan, or logo.

In summary, the above described multi functional hat provides for ease of use and various application, thus providing significant advances in thermal apparel and cost savings.

It is to be understood that the present invention is not limited to the sole embodiment described above, but encompasses any and all embodiments within the scope of the disclosure and the following claims.

I claim:

1. A multifunctional hat comprising:

a body having an open end adapted to receive an object;

said body having a fold proximate to and circumscribing said open end; and a visor, mounted independently of said fold on said body so that said visor is external of said fold;

wherein said fold is adapted to be unfolded so as to contact the object.

2. A multifunctional hat as in claim 1, wherein said visor is positioned relative to said body so as to discourage said fold from extending therebeyond when said fold is unfolded.

3. A multifunctional hat comprising:

a body having an open end adapted to receive an object;

said body having a fold proximate to and circumscribing said open end;

a visor, mounted independently of said fold on said body so that said visor is external of said fold; and a reinforced seam sealing a top of said body.

4. A multifunctional hat comprising:

a body having an open end adapted to receive an object;

said body having a fold proximate to and circumscribing said open end; and a visor, mounted independently of said fold on said body so that said visor is external of said fold;

wherein said body is folded and sewn in the shape of a hemisphere.

5. A multifunctional hat comprising:

a body having an open end adapted to receive an object; said body having a fold proximate to and circumscribing said open end;

a visor, mounted on said body; and a flap mounted on said visor.

6. A multifunctional hat as in claim 5, wherein said flap is made of absorbent material.

7. A multifunctional hat as in claim 5, wherein said flap is adapted to contact the object.

8. A multifunctional hat as in claim 5, wherein said flap is joined to said body, along a back of said visor and behind said fold.

9. A multifunctional hat as in claim 5, wherein said flap corresponds to a shape of said visor.

10. A multifunctional hat comprising:

a body having an open end adapted to receive an object;

said body having a fold proximate to and circumscribing said open end;

a visor, mounted independently of said fold on said body so that said visor is external of said fold; and indicia on said fold.

* * * * *